US008221255B1

(12) United States Patent
Wang

(10) Patent No.: US 8,221,255 B1
(45) Date of Patent: Jul. 17, 2012

(54) GOLF SWING TRAINING DEVICE

(76) Inventor: Richard C. Wang, Kapolei, HI (US)

( * ) Notice: Subject to any disclaimer, the term of this patent is extended or adjusted under 35 U.S.C. 154(b) by 0 days.

(21) Appl. No.: 13/080,984

(22) Filed: Apr. 6, 2011

(51) Int. Cl.
*A63B 69/36* (2006.01)

(52) U.S. Cl. ..... 473/213; 473/227; 473/409

(58) Field of Classification Search ..... 473/201, 473/205, 206, 207, 212, 213, 226, 227, 266, 473/409
See application file for complete search history.

(56) References Cited

U.S. PATENT DOCUMENTS 2,273,416 A * 2/1942 Norwood ..... 473/206
3,951,416 A * 4/1976 Koch et al. ..... 473/212
5,116,057 A * 5/1992 Mangiaracina ..... 473/213
5,145,179 A 9/1992 Breed
5,203,568 A 4/1993 Vasquez
5,248,146 A 9/1993 Viets et al.
5,259,621 A 11/1993 Keefer
5,452,891 A * 9/1995 Thomas ..... 473/294
5,470,073 A 11/1995 Vasquez
5,501,464 A 3/1996 Dalbo
D372,064 S * 7/1996 del Barrio ..... D21/791
5,762,565 A * 6/1998 Milam et al. ..... 473/271
5,902,189 A 5/1999 Schultz
6,004,221 A 12/1999 Thornhill
6,719,639 B2 * 4/2004 Novosel, Sr. ..... 473/213

* cited by examiner

*Primary Examiner* — Nini Legesse
(74) *Attorney, Agent, or Firm* — Montgomery Patent & Design, LLC; Robert C. Montgomery; Joseph Yaksich

(57) ABSTRACT

A golf swing training device to aid a golfer in keeping their wrists in a proper position throughout a golf swing includes a golf club grip clip, an adjustable spacer rod, and a wrist strap. The wrist strap includes an adjustable and securable fabric strap which engages the golfer's wrist. The wrist strap is affixed to the length adjustable spacer rod which is in turn attached to the grip clip. The grip clip engages the grip end of the golf club such that the golfer's wrists are confined to a predetermined distance and angle during a golf swing for purposes of training. The device may be used singularly or as a pair, if desired, to allow for simultaneous training of both wrists.

15 Claims, 3 Drawing Sheets

GOLF SWING TRAINING DEVICE

RELATED APPLICATIONS

The present invention was first described in a notarized Official Record of Invention on Jun. 17, 2010, that is on file at the offices of Montgomery Patent and Design, LLC, the entire disclosures of which are incorporated herein by reference.

FIELD OF THE INVENTION

The present invention relates generally to golf training devices, and in particular, to a training device for practicing a golf swing to reinforce a correct position of an arm relative to a golf club during the golf swing.

BACKGROUND OF THE INVENTION

The game of golf has become one the most technologically advanced sports in the world. Experts in science and physics have combined state of the art materials with ergonomic and aerodynamic principles in order to produce golf clubs and golf balls that produce more accurate and consistently longer golf shots. Even with all of this technology people still have difficulty in mastering the basics of the game. One (1) of these basics is the ability to keep one's wrists in the correct position throughout the entire swing. The wrists of many or even most golfers move about haphazardly during a swing. This movement then causes the face of the club to move wildly, resulting in balls that slice off to the left or right. While various coaching methods exist to help combat this condition, it remains a problem for many golfers.

Various training devices have attempted to provide assistance with this problem and train golfers how to properly maintain the position of the hands and forearms relative to the golf club during the golf swing. Many of these devices focus on setting the distance between and holding the position of the arms while gripping the club. Other devices provide extension members of varying complexity which attach to the club to reinforce the position of the club within the golfer's hands. Many of these devices focus on putting and are intended for use with a golf putter.

While these devices may achieve their purported objective each suffers from one or more disadvantage or deficiency related to design or utilization. Particularly, these devices lack a simple way to adjust and secure the distance between the golfer's forearm and wrist portions relative to the golf club. Depending upon the specific type of club being used, the location of the hands on the club and the relative distance and angle between the arms and the club varies. Prior devices do not account for this variation or require different training aids for different types of clubs. Additionally, these devices do not provide for a way to automatically disengage from or release the club at the appropriate time during execution of the swing.

SUMMARY OF THE INVENTION

The inventor has therefore recognized the aforementioned inherent problems and lack in the art and observed that there is a need for a device and method of use in which a golfer's wrists can be properly placed during a golf swing. In accordance with the invention, it is an object of the present disclosure to solve these problems.

The inventor recognized these problems and has addressed this need by developing a golf swing training device that aids golfers in developing a better golf swing in a quick, easy, and effective manner. The inventor has thus realized the advantages and benefits of providing a grip clip which is releasably connected to a grip of a golf club. A lower rod is affixed to an exterior surface of the grip clip and an upper rod is adjustably coupled to the lower rod opposite the clip grip. A wrist strap is affixed to an end of the upper rod opposite the lower rod and is fastened around at least one wrist of the golfer. Use of the device ensures that at least one wrist of the golfer is securely positioned in relation to the golf club grip during a golf swing.

The lower rod is a cylindrical member having male thread on an exterior surface and the upper rod is a tubular member having female thread on an interior surface. The lower rod is threadingly inserted within the upper rod to define an adjustable distance between the golfer's wrist and the golf club grip.

The clip grip is formed of a durable plastic material capable of deforming outwardly for connection of the grip clip to the golf club grip and returning to a non-deformed state in compressive contact around the golf club grip prior to the golf swing. At an appropriate point in the golf swing when the arms naturally move in relation to the golf club, the clip grip disengages from the golf club grip.

Furthermore, the described features and advantages of the disclosure may be combined in various manners and embodiments as one skilled in the relevant art will recognize. The disclosure can be practiced without one (1) or more of the features and advantages described in a particular embodiment.

Further advantages of the present disclosure will become apparent from a consideration of the drawings and ensuing description.

BRIEF DESCRIPTION OF THE DRAWINGS

The advantages and features of the present disclosure will become better understood with reference to the following more detailed description and claims taken in conjunction with the accompanying drawings, in which like elements are identified with like symbols, and in which:

| DESCRIPTIVE KEY | |
|---|---|
| 10 | golf swing training device |
| 20 | grip clip |
| 21 | clip gap |
| 25 | lower rod |
| 30 | upper rod |
| 35 | wrist strap |
| 80 | fastener |
| 85a | first fastener section |
| 85b | second fastener section |
| 100 | golfer |
| 105 | wrist |
| 107 | hand |
| 115 | golf club |

DETAILED DESCRIPTION OF THE PREFERRED EMBODIMENT

Figure 1:
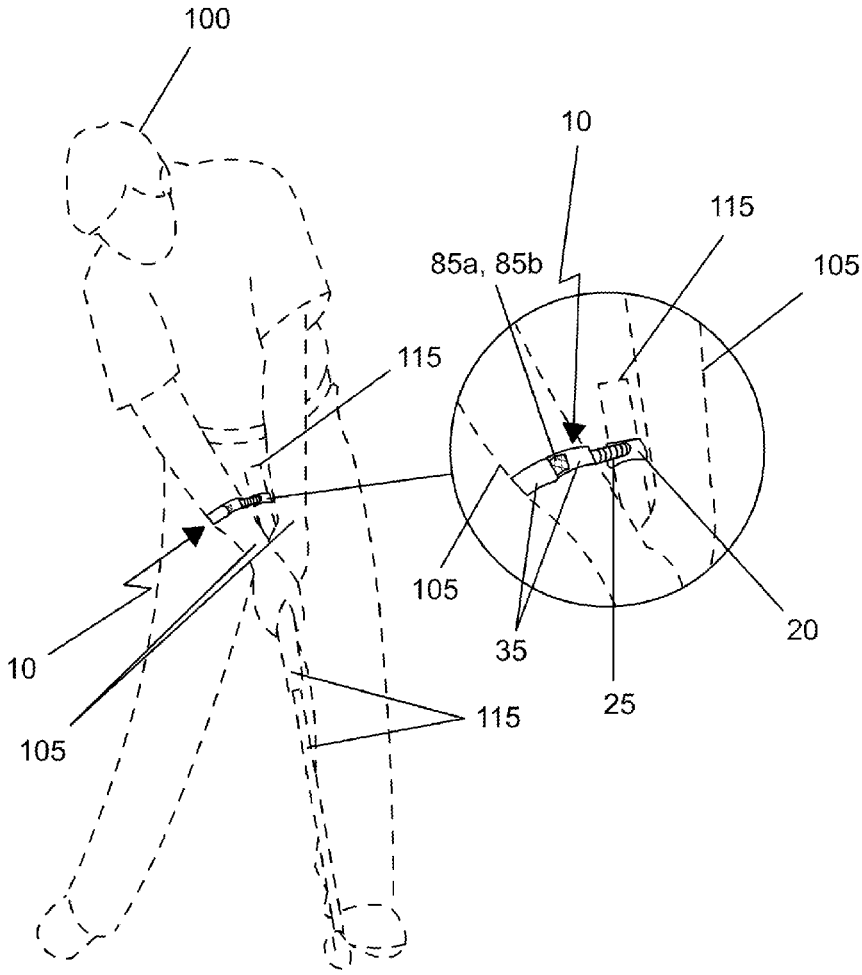
FIG. 1 is an environmental view of a golf swing training device, according to a preferred embodiment in accordance with the invention.
Figure 2:
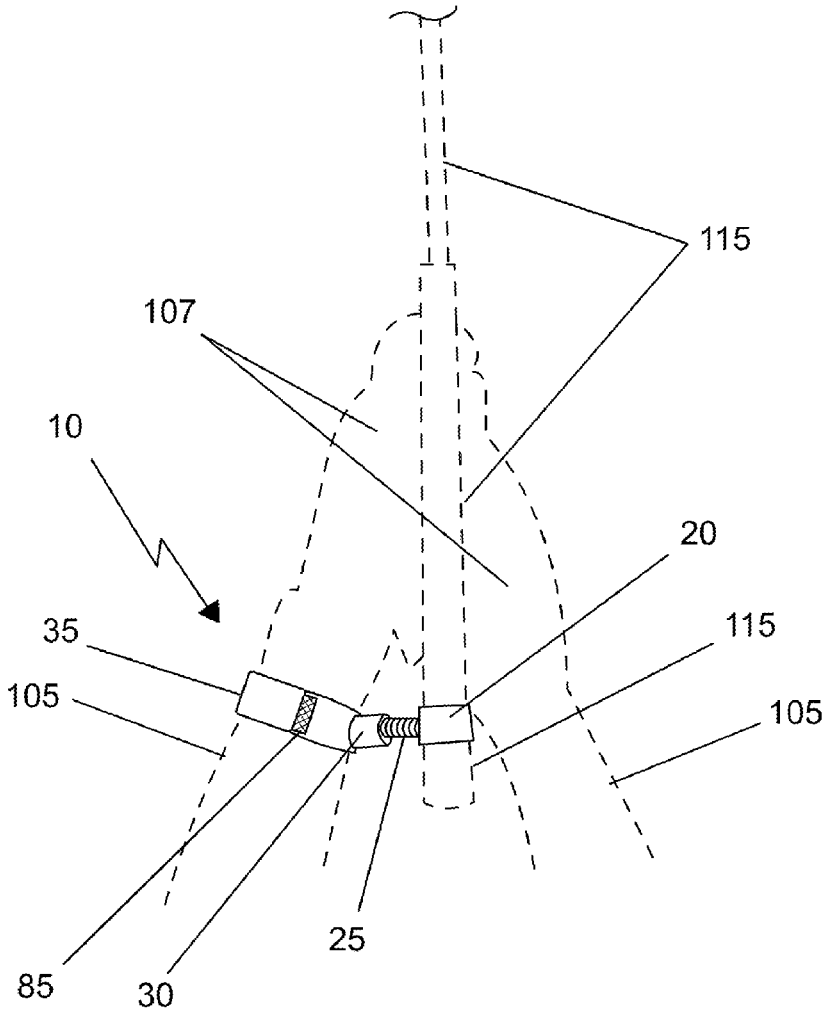
FIG. 2 is a top view of the golf swing training device depicted in an in-use state, according to the preferred embodiment; and, FIG. 3 is a perspective view of the golf swing training device, according to the preferred embodiment.
Figure 3:
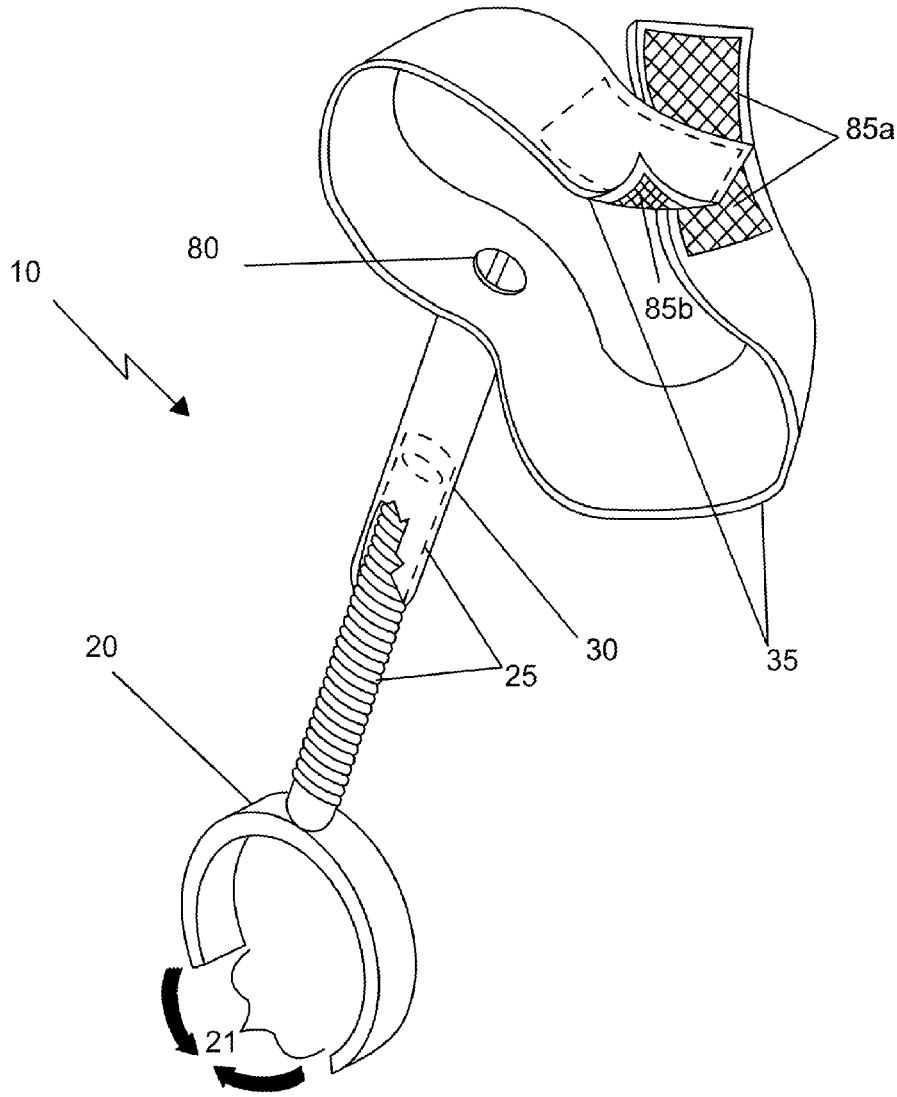

In accordance with the invention, the best mode is presented in terms of a preferred embodiment, herein depicted within FIGS. 1 through 3. However, the disclosure is not limited to a single described embodiment and a person skilled in the art will appreciate that many other embodiments are possible without deviating from the basic concept of the disclosure and that any such work around will also fall under its scope. It is envisioned that other styles and configurations can be easily incorporated into the teachings of the present disclosure, and only one particular configuration may be shown and described for purposes of clarity and disclosure and not by way of limitation of scope.

The terms "a" and "an" herein do not denote a limitation of quantity, but rather denote the presence of at least one of the referenced items.

Referring now to FIGS. 1 through 3, depicting a golf swing training device (herein described as a "device") 10, where like reference numerals represent similar or like parts. In accordance with the invention, the present disclosure describes a device 10 that aids in training a golfer 100 during practice of a golf swing to keep the golfer's wrist 105 in a proper position throughout the golf swing. The device 10 provides a rigid connection between the wrist 105 and a golf club 115, thereby setting the distance and angle of the wrist 105 in relation to the golf club 115 while gripping the golf club 115 in the hands 107 during the swing.

FIGS. 1 and 2 show an environmental view and a top view of the, device 10. It can be appreciated by one skilled in the art that the device 10 acts as an equally effective aid when used on a variety of different types of golf clubs 115 such as drivers, irons, and putters. The device 10 provides a rigid mechanical attachment between a grip of the golf club 115 and the golfer's wrist 105 through a respective grip clip 20 and a wrist strap 35. The grip clip 20 is releasably attached to the golf club 115 allowing automatic detachment during a follow-through of the golf swing. The device 10 can be used singularly on either a right or left wrist 105 or as a pair of devices 10 used on both wrists 105 coincidentally.

FIG. 3 shows a perspective view of the golf swing training device 10. The device 10 includes the grip clip 20, a lower rod 25, an upper rod 30, and the wrist strap 35. The grip clip 20 is a cylindrically-shaped ring preferably made of a durable plastic material manufactured in an injection-molding process and is preferably introduced in a variety of attractive colors. The ring of the grip clip 20 has an open center diameter of approximately one (1) inch and a clip gap 21 disposed on the perimeter of the ring of approximately one-half (½) of an inch wide. The grip clip 20 is engaged around the circumference of the golf club 115 and is in compressive contact with the upper grip portion of the club 115. The clip gap 21 allows for the golf club 115 to be released and for the detachment of the grip clip 20 from the golf club 115 during the follow-through of the golf swing. The grip clip 20 also includes an integrally molded lower rod 25 which extends perpendicularly outward at a location opposite the clip gap 21.

The lower rod 25 is a male portion having an exterior threaded surface for threading engagement with the upper rod 30. The upper rod 30 is a female portion having an interior threaded surface for threadingly receiving the lower rod 25. The rod 25, 30 threadingly attached along a common linear axis and rotation of the lower 25 relative to the upper rod 30 provide for a length adjustment capable of varying the distance between the grip clip 20 and the wrist strap 35 from approximately two (2) to three (3) inches. A flat end of the upper rod 30 provides a mounting surface for attachment of the wrist strap 35 by a fastener 80 such as a rivet, screw, or similar mechanical fastener. The fastener 80 securely affixes the wrist strap 35 to the end of the upper rod 30.

The wrist strap 35 extends laterally from the end of the upper rod 30 in both directions providing a total length of approximately eleven (11) inches. The wrist strap 35 is preferably made using a durable and washable textile material such as, but not limited to: vinyl, canvas, nylon, or the like, and being introduced in a variety of colors and patterns based upon a user's 100 preference. The wrist strap 35 is capable of encompassing the wrist 105 of the golfer 100. The wrist strap 35 also includes a securing first fastener section 85*a* and a second fastener section 85*b* disposed on opposing end portions. The fastener sections 85*a*, 85*b* are preferably communication sections of a hook and loop fastener sewn to the wrist strap 35 on opposing top and bottom surfaces of each end portion. The fastener sections 85*a*, 85*b* are intended to allow the golfer 100 to loop and secure the wrist strap 35 around the appropriate wrist 105 when using the device 10. It can be appreciated that other fasteners can be utilized to secure the wrist strap 35 around the wrist 105, including but not limited to, snaps, hooks, slip fit fasteners, and the like.

It is envisioned that other styles and configurations can be easily incorporated into the teachings of the present disclosure and only one particular configuration has been shown and described for purposes of clarity and disclosure and not by way of limitation of scope.

In accordance with the invention, the preferred embodiment can be utilized by the user in a simple and effortless manner with little or no training. After initial purchase or acquisition of the device 10, it would be installed and utilized as indicated in FIGS. 1 and 2.

The method of installing the device 10 can be achieved by performing the following steps: procuring a model of the device 10 having a desired color; selecting an golf club 115 for application of the device 10; attaching the device 10 to the grip portion of the golf club 115 by flexing the grip clip 20 open and forcing the clip gap 21 over the grip portion of the golf club 115; wrapping the wrist strap 35 around a right or left wrist 105; attaching the wrist strap 35 securely around the wrist 105 by attaching the fastener sections 85*a*, 85*b*; adjusting the combined length of the lower rod 25 and upper rod 30 as needed to obtain a desired angle and distance between the golf club 115 and the wrist 105 while grasping the golf club 115 in the hands 107; adjusting the length of the device 10 by disconnecting the grip clip 20 from the golf club 115; rotating the lower rod 25 with respect to the upper rod 30 until obtaining the desired length; and, replacing the grip clip 20 upon the golf club 115. The device 10 is now ready for a user 100 to practice the golf swing.

The method of utilizing the device 10 to practice the golf swing is performed in a similar fashion as a normal unaided golf swing; however, use of the device 10 will maintain the distance and angle of the golf club 115 in relation to the wrist 105 during the practice golf swing. The clip gap 21 of the grip clip 20 will automatically allow detachment of the device 10 from the golf club 115 during the follow through of the swing, as needed. The device 10 may be used singularly on either wrist 105 or a pair of devices 10 can be used on both wrists coincidentally to obtain desired golf ball striking results. With the device 10 properly positioned, the wrist 105 is effectively connected to the golf club 115 making it nearly impossible to change a distance or angle of the wrist 105 in relation to the golf club 115 during the ball contact of the swing. The device 10 produces golf club swings which produce longer, more accurate and more consistent results. The use of the device 10 aids golfers 100 in developing a better golf swing in a quick, easy, and effective manner.

The foregoing descriptions of specific embodiments have been presented for purposes of illustration and description.

They are not intended to be exhaustive or to limit to the precise forms disclosed and many modifications and variations are possible in light of the above teachings. The embodiments were chosen and described in order to best explain principles and practical application to enable others skilled in the art to best utilize the various embodiments with various modifications as are suited to the particular use contemplated.

What is claimed is:

1. A golf swing training device comprising:

a grip clip releasably connected to a grip of a golf club;

a lower rod affixed to an exterior surface of said grip clip;

an upper rod adjustably coupled to said lower rod opposite said clip grip; and, a wrist strap affixed to an end of said upper rod opposite said lower rod, said wrist strap comprising an elongated flexible fabric member suitable to be fastened completely around a wrist of a user;

wherein said wrist of said user is securely positioned in relation to said golf club grip during a golf swing.

2. The device of claim 1, wherein said grip clip further comprises a ring having a clip gap defining an open area along a perimeter, said clip gap is disposed opposite said lower rod.

3. The device of claim 2, wherein said lower rod further comprises a cylindrical member having male threads on an exterior surface and said upper rod further comprises a tubular member having female threads on an interior surface;

wherein said lower rod is threadingly inserted within said upper rod to define an adjustable distance between said wrist and said golf club grip.

4. The device of claim 3, wherein said clip grip is formed of a durable plastic material capable of deforming outwardly for connection of said grip clip to said golf club grip and returning to a non-deformed state in compressive contact around said golf club grip.

5. The device of claim 4, wherein said wrist strap further comprises a fastener section disposed on opposing ends of said fabric member for securing said wrist strap in place around said wrist portion.

6. The device of claim 5, wherein said wrist strap is affixed to said upper rod end by a mechanical fastener.

7. The device of claim 6, wherein said fastener sections further comprise communicating sections of hook and loop fastener.

8. A golf swing training device comprising:

a length adjustable rigid spacer rod having opposing ends;

a length adjusting mechanism comprising a pair of telescoping rod members, each of said rod members are adjustable relative to each other to define an overall length of said spacer rod;

a grip clip affixed to an end of said spacer rod removable attachment to an upper grip portion of a golf club; and, a wrist strap fastened to an end of said spacer rod opposite said grip clip, said wrist strap comprising an elongate elastic strap member suitable to be removably fastened completely around a wrist of a user;

wherein said wrist of said user is securely positioned at said overall length defined by said spacer rod in relation to said golf club upper grip portion during a golf swing.

9. The device of claim 8, wherein said grip clip further comprises a flexible "C"-shaped member; and, wherein ends of said "C"-shaped member compressively engage around said golf club upper grip portion.

10. The device of claim 9, wherein said spacer rod extends generally perpendicularly from said grip clip opposite said ends of said "C"-shaped member.

11. The device of claim 10, wherein said wrist strap further comprises a fastener section disposed on opposing ends of said strap member for securing said wrist strap in place around said wrist portion.

12. The device of claim 11, wherein said fastener sections further comprise communicating sections of hook and loop fastener.

13. The device of claim 12, wherein said wrist strap is affixed to said upper rod end by a mechanical fastener.

14. A method of practicing a golf swing to retain an arm in a stable position relative to a golf club during said golf swing, said method comprising the steps of:

providing a golf club having a grip, a shaft, and a head;

providing a golf swing training device comprising a grip clip, a lower rod affixed to an exterior surface of said grip clip, an upper rod adjustably coupled to said lower rod opposite said clip grip, and a wrist strap affixed to an end of said upper rod opposite said lower rod;

removably attaching said grip clip to said golf club grip adjacent to an end of said golf club;

rotating said upper rod relative to said lower rod to define an overall length between said grip clip and said wrist strap;

fastening said wrist strap to a wrist, wherein said wrist is securely positioned in relation to said golf club grip; and, executing said golf swing.

15. The method of claim 14, further comprising the steps of:

providing another golf swing training device comprising a grip clip, a lower rod affixed to an exterior surface of said grip clip, an upper rod adjustably coupled to said lower rod opposite said clip grip, and a wrist strap affixed to an end of said upper rod opposite said lower rod;

removably attaching said grip clip of said another golf swing training device to said golf club grip adjacent to an end of said golf club and said previously attached grip clip of said golf swing; training device;

rotating said upper rod of said another golf swing training device relative to said lower rod of said golf swing training device to define an overall length between said grip clip of said golf swing training device and said wrist strap of said golf swing training device;

fastening said wrist strap of said another golf swing training device to an opposing wrist, wherein said opposing wrist is securely positioned in relation to said golf club grip; and, executing said golf swing.

* * * * *